US009815302B2

(12) United States Patent
Hara et al.

(10) Patent No.: US 9,815,302 B2
(45) Date of Patent: Nov. 14, 2017

(54) MEDIUM TRANSPORTING APPARATUS

(71) Applicant: SEIKO EPSON CORPORATION, Tokyo (JP)

(72) Inventors: Shun Hara, Nagano (JP); Shinichiro Yoshikawa, Nagano (JP); Tomohiro Yasufuku, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/434,416

(22) Filed: Feb. 16, 2017

(65) Prior Publication Data

US 2017/0274674 A1 Sep. 28, 2017

(30) Foreign Application Priority Data

Mar. 24, 2016 (JP) ..... 2016-059680

(51) Int. Cl.
*B41J 11/00* (2006.01)

(52) U.S. Cl.
CPC ..... *B41J 11/0045* (2013.01)

(58) Field of Classification Search
CPC ..... B41J 15/044; B41J 15/048; B41J 15/18; B41J 17/02; B41J 17/18; B41J 17/20; B41J 11/006; B41J 11/0065; B41J 11/007; B41J 11/58; B41J 11/0045; B41J 13/0054; B41J 13/103; B41J 13/106; B41J 13/12
See application file for complete search history.

(56) References Cited

U.S. PATENT DOCUMENTS

| | | | | |
|---|---|---|---|---|
| 7,651,287 | B2 * | 1/2010 | Numata | B41J 2/325 347/214 |
| 8,328,442 | B2 * | 12/2012 | Bandholz | B41J 2/325 400/221 |
| 2002/0041782 | A1 * | 4/2002 | Mastinick | B41J 29/02 400/192 |
| 2004/0071487 | A1 * | 4/2004 | Ono | B41J 2/325 400/120.01 |
| 2015/0274477 | A1 | 10/2015 | Kodama | |

FOREIGN PATENT DOCUMENTS

| | | | |
|---|---|---|---|
| JP | 2007-030195 | A | 2/2007 |
| JP | 2015-189006 | A | 11/2015 |

* cited by examiner

*Primary Examiner* — Kristal Feggins
(74) *Attorney, Agent, or Firm* — Global IP Counselors, LLP

(57) ABSTRACT

A printer includes a housing, a cover, and a movable unit. The housing has a space and an opening. The space accommodates a transportation path section that is at least part of a transportation path for transporting a paper sheet. The opening allows the space to communicate with the outside of the housing. The cover is in any one of positions relative to the opening including a closed position where the cover covers the opening and an open position where the cover uncovers the opening. The movable unit has the transportation path section and is movable between a storage position where the transportation path section is stored in the space and a pulled-out position where the transportation path section is pulled out of the space. The movable unit in the pulled-out position is restrained from moving toward the storage position when the cover is in the open position.

6 Claims, 9 Drawing Sheets

MEDIUM TRANSPORTING APPARATUS

BACKGROUND

1. Technical Field

The present invention relates to a medium transporting apparatus for transporting a medium, such as a paper sheet, to a recording section that records an image on the medium.

2. Related Art

Some medium transporting apparatuses have a printing device that records an image, including characters and photographs, on a paper sheet as an example of a medium by applying ink. For example, a medium transporting apparatus described in JP-A-2015-189006 includes a housing that has an inner space in which a transportation path section that transports a medium is provided, and a movable unit at least part of which is located in the space. The movable unit is movable relative to the housing between a storage position and a pulled-out position. The movable unit moves from the storage position to the pulled-out position when the movable unit is pulled out of the space. In this medium transporting apparatus, a paper sheet that is jammed in the transportation path section in the space can be removed by moving the movable unit from the storage position to the pulled-out position.

Sometimes a paper sheet that is transported may become warped or fall out of the transportation path section into the space. If the housing has an opening in communication with the space, a paper sheet in such an inappropriate state can be removed from the space through the opening. In this case, if the movable unit is returned to the storage position from the pulled-out position without removing the paper sheet in the space, the paper sheet may become caught between the movable unit and the housing. As a result, the paper sheet may become crumpled or torn, and thus it is difficult to remove the paper sheet.

SUMMARY

An advantage of some aspects of the invention is that a medium transporting apparatus that reduces the likelihood of difficulty in removing a medium is provided.

Advantageous effects will be described. A medium transporting apparatus according to an aspect of the invention includes a housing, a cover, a movable unit, and a limiter. The housing has a space and an opening. The space accommodates a transportation path section that is part of a transportation path for transporting a medium. The opening allows the space to communicate with the outside of the housing. The cover is in any one of relative positions relative to the opening. The relative positions include a closed position where the cover covers the opening and an open position where the cover uncovers the opening. The movable unit includes the transportation path section and is movable between a storage position where the transportation path section is stored in the space and a pulled-out position where the transportation path section is pulled out of the space. The limiter restrains the movable unit in the pulled-out position from moving toward the storage position when the cover is in the open position. The limiter allows the movable unit in the pulled-out position to move toward the storage position when the cover is in the closed position.

According to this aspect, the limiter restrains the movable unit in the pulled-out position from moving toward the storage position when the cover is in the open position. As such, when the cover is in the open position, the movement of the movable unit toward the storage position is restrained until a user returns the cover back to the closed position from the open position. A user is accordingly prompted to visually check the space through the opening when returning the cover back to the closed position from the open position. This reduces the likelihood of the movable unit being returned to the storage position without removal of a medium that is in the space in an inappropriate state, thus reducing the likelihood of difficulty in removing the medium.

In the medium transporting apparatus, preferably, the limiter includes a first engagement member and a second engagement member. The first engagement member is provided at a cover side of the movable unit. The second engagement member is provided at a portion of the housing that is covered by the cover when the cover is in the closed position. The second engagement member has a first end capable of being in contact with the cover and a second end capable of engaging with the first engagement member. The second engagement member is biased to allow the second end to engage with the first engagement member. When the cover is in the closed position, the first end is in contact with the cover so that the second end is separated from the first engagement member to allow the movement of the movable unit. When the cover is in the open position, the first end is separated from the cover so that the second end engages with the first engagement member to restrain the movement of the movable unit.

According to this aspect, the limiter restrains the movement of the movable unit by using a mechanism that separates the first end of the second engagement member from the cover so that the second end of the second engagement member can engage with the first engagement member. This restrains the movement of the movable unit from the pulled-out position to the storage position without using additional devices, such as driving sources or sensors.

In the medium transporting apparatus, preferably, the limiter may have multiple first engagement members that include the first engagement member and that are arranged in a direction in which the movable unit is movable. Each of the first engagement members is a recess having a first surface on a pulled-out-position side and a second surface on a storage-position side. The second surface of each of the first engagement members is inclined toward the outside of the movable unit in a direction from the pulled-out-position side to the storage-position side. When the movable unit moves toward the pulled-out position while the cover is in the open position, the second end of the second engagement member is movable along the second surface.

When the movable unit moves toward the pulled-out position, the likelihood of the medium that is in the space in an inappropriate state being crumpled or torn is small, as compared to when the movable unit moves toward the storage position. Therefore, allowing the movement of the movable unit toward the pulled-out position is acceptable. In view of the above, the movable unit can be allowed to move toward the pulled-out position regardless of whether the cover is in the open position or in the closed position. As such, to move the movable unit toward the pulled-out position, a user does not have to return the cover in the open position back to the closed position. This decreases a possibility of impairing usability.

In the medium transporting apparatus, preferably, the second end of the second engagement member can have a first surface on a pulled-out-position side and a second surface on a storage-position side. The second surface of the second end is inclined so that a distance between the movable unit and the second surface of the second end increases in the direction from the pulled-out-position side to the storage-position side. The second surface of each of the first engagement members and the second surface of the second end are slidable relative to each other. The first surface of the second end and the first surface of any of the first engagement members are in contact with each other to restrain the movement of the movable unit.

According to this aspect, when the movable unit moves, the second surface of the first engagement member and the second surface of the second end slide relative to each other. Accordingly, when the movable unit moves in the direction to reduce the covered area of the opening, the second end is less likely to be caught by the first engagement member, and the movable unit moves smoothly.

Preferably, the medium transporting apparatus may further include a sensor, a motor, and a controller. The sensor detects the relative position of the cover. The motor drives the limiter. The controller controls the motor in accordance with the output of the sensor so that the limiter restrains the movable unit in the pulled-out position from moving toward the storage position when the cover is in the open position.

According to this aspect, the controller controls the motor in accordance with the relative position of the cover to allow or restrain the movement of the movable unit. Thus, the limiter is driven with appropriate timing.

In the medium transporting apparatus, preferably, the movable unit in the pulled-out position allows the transportation path section to be exposed. According to this aspect, a medium jammed in the transportation path section included in the movable unit can be removed by moving the movable unit to the pulled-out position.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
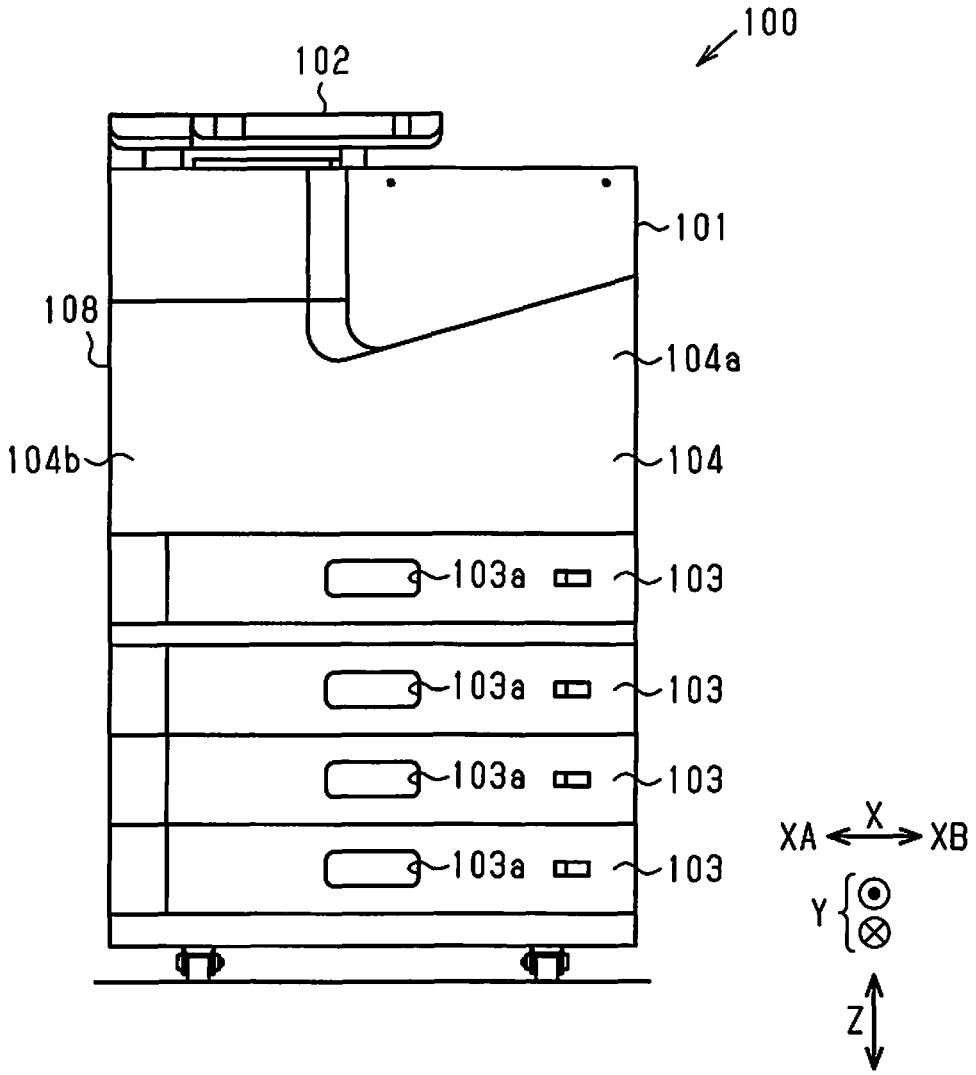
FIG. 1 is a front view of a printer as an example of a medium transporting apparatus according to an embodiment.

A printer 100 as an example of a medium transporting apparatus is described below with reference to the drawings. As illustrated in FIG. 1, the printer 100 is an ink jet printer held in a housing 101 that is shaped like a rectangular box. The printer 100 records an image, including characters and photographs, on a paper sheet P (refer to FIG. 2) as an example of a medium by applying ink as an example of a liquid to the paper sheet P. An operation section 102 used to control the operations of the printer 100 is attached to the top of the housing 101 in a vertical direction Z.

The printer 100 has paper cassettes 103 that are provided in a region that extends from the middle to the bottom of the printer 100 in the vertical direction Z. According to the present embodiment, four paper cassettes 103 are aligned in the vertical direction Z, and each paper cassette 103 holds a stack of paper sheets P (refer to FIG. 2) on which the printer 100 records an image. A grip 103*a* to be grasped by a user is formed in the middle of each paper cassette 103 in a right/left direction X. As such, the paper cassettes 103 can be inserted in and removed from the housing 101 in a front/rear direction Y that intersects with each of the right/left direction X and the vertical direction Z. The paper cassettes 103 can hold the same or different types of paper sheets P.

A cover 104 is provided adjacent to the topmost paper cassette 103 in the vertical direction Z. The cover 104 is rotatable relative to a side wall 105 (refer to FIG. 3) around a base end 104*a* (a right end in FIG. 1) of the cover 104 in the right/left direction X. The side wall 105 defines the front face of the housing 101. A tip end 104*b* (a left end in FIG. 1) of the cover 104 in the right/left direction X is provided with a grip 104*c* (refer to FIG. 3) to be grasped by a user. The position of the cover 104 relative to the housing 101 changes between a closed position illustrated in FIGS. 1 and 8 and an open position illustrated in FIGS. 3 and 10. When the cover 104 is in the closed position, the tip end 104*b* is in contact with the housing 101. When the cover 104 is in the open position, the tip end 104*b* is separated from the housing 101. Thus, the cover 104 is moved and rotated between the closed position and the open position by a user grasping the grip 104*c* (refer to FIG. 3).

Figure 2:
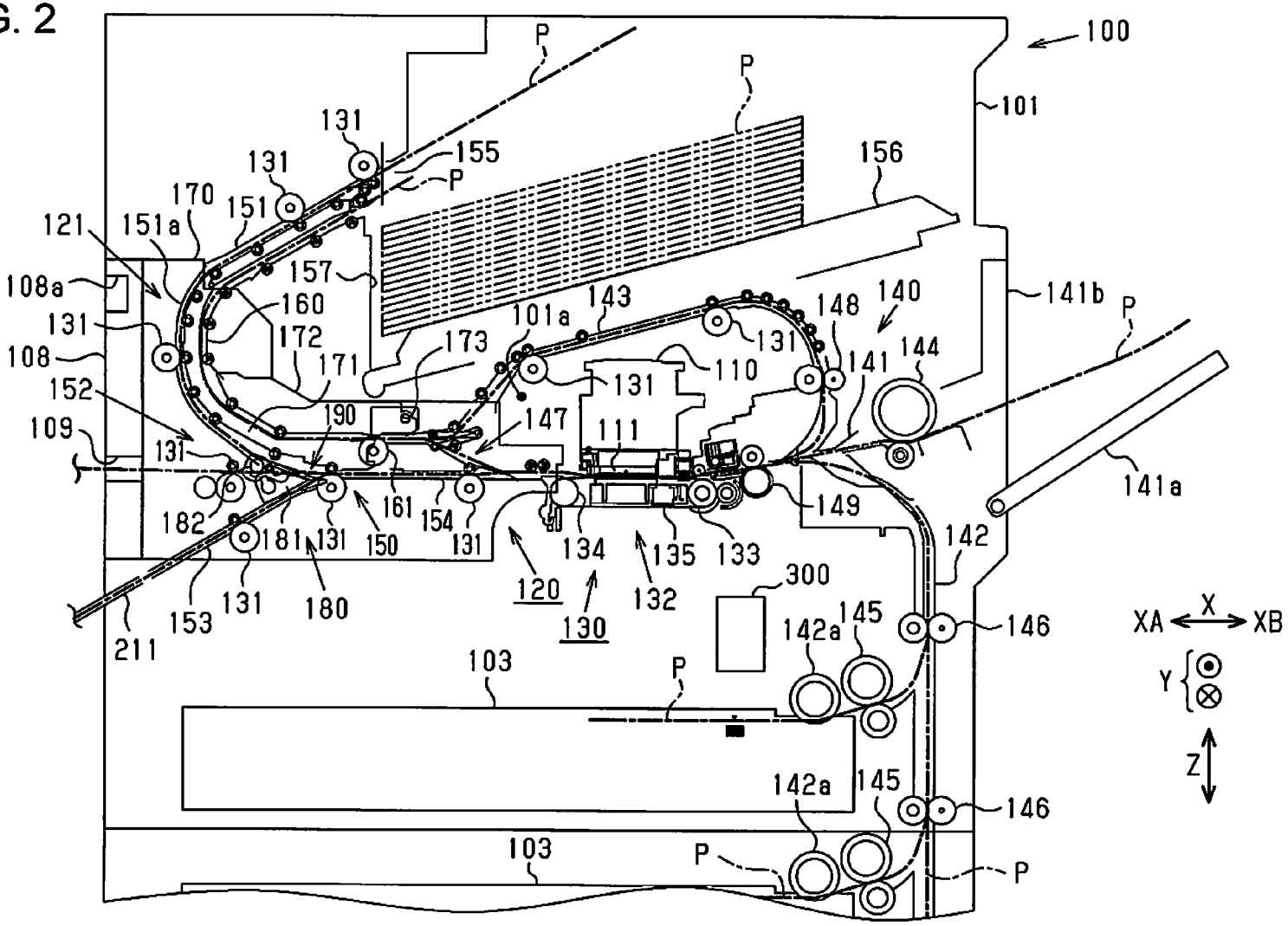
FIG. 2 is a schematic view of the printer.
Figure 3:
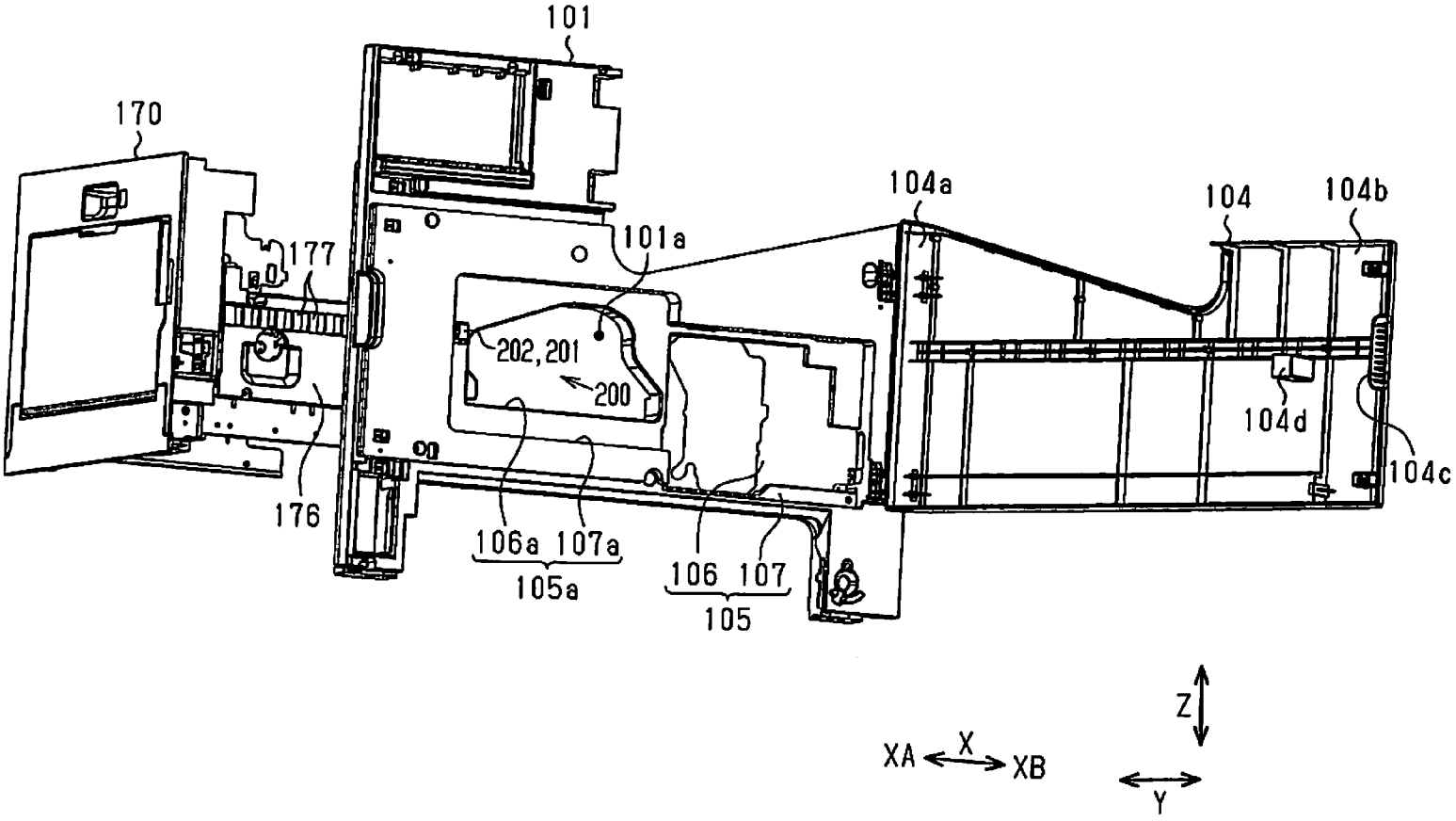
FIG. 3 is a perspective view illustrating a housing, a movable unit, and a cover.

As illustrated in FIG. 3, the side wall 105 includes a first side wall 106 located inside the printer 100 and a second side wall 107 attached to the outside of the first side wall 106. For example, the first side wall 106 may be made of a metal material, and the second side wall 107 may be made of a resin material. The first side wall 106 has a first opening 106*a* corresponding to a first portion of an inner space 101*a* of the housing 101. The first portion of the space 101*a* is located on the downstream side of a recording section 110 (refer to FIG. 2) in a transportation path 120. The second side wall 107 has a second opening 107*a* larger than the first opening 106*a*. The second opening 107*a* covers the whole of the first opening 106*a*. The first opening 106*a* and the second opening 107*a* define an opening 105*a* of the side wall 105. Thus, the side wall 105 of the housing 101 has the opening 105*a* in communication with the space 101*a*. The cover 104 covers the opening 105*a* in the closed position, and uncovers the opening 105*a* in the open position. The opening 105*a* allows a user to perform maintenance, including removing jammed paper sheet P in the space 101*a*.

As illustrated in FIG. 2, a pullout wall 108 is provided on the left surface of the printer 100 in the right/left direction X. The pullout wall 108 can be pulled out from the housing 101. A grip 108*a* to be grasped by a user is formed at the upper portion of the pullout wall 108 in the vertical direction Z. When the pullout wall 108 is pulled out from the housing 101 in a pullout direction which is the left of the right/left direction X, a movable unit 170 is pulled out from the housing 101 accordingly (refer to FIGS. 3 and 4). Details of the movable unit 170 are described later.

As illustrated in FIG. 2, the pullout wall 108 has a discharge slot 109 that is located below the grip 108*a* in the vertical direction Z. After the image is recorded on the paper sheet P, the paper sheet P is discharged from the discharge slot 109. Although not illustrated in the drawings, the discharge slot 109 is provided with a paper discharge tray.

Next, the structure of the printer 100 is described. As illustrated in FIG. 2, the housing 101 has the space 101*a* in which the components of the printer 100 are arranged. Specifically, the recording section 110 and a transporting section 130 are provided in the space 101*a*. The recording section 110 records the image on the paper sheet P from above in the vertical direction Z. The transporting section 130 transports the paper sheet P in the transportation path 120. As such, at least part of the transportation path 120 for transporting the paper sheet P is located in the space 101*a*. The transportation path 120 allows the paper sheet P to be transported in a transporting direction which intersects with the width direction of the paper sheet P which is parallel to the front/rear direction Y.

A recording head 111 is provided at a lower portion of the recording section 110. The recording head 111 is a so-called line head capable of discharging ink over almost the entire width of the paper sheet P at the same time. The recording section 110 forms the image on the paper sheet P by the recording head 111 facing the recording side (i.e., the side on which the image is printed) of the paper sheet P to apply ink discharged from the recording head 111 to the recording side of the paper sheet P.

The transporting section 130 includes multiple transporting roller pairs 131 arranged along the transportation path 120 and a belt transporter 132 positioned directly below the recording section 110. The recording head 111 discharges ink onto the paper sheet P being transported by the belt transporter 132, thus recording the image on the paper sheet P.

The belt transporter 132 includes a driving roller 133, a driven roller 134, and a belt 135 which is shaped like a continuous ring without ends. The driving roller 133 is located on the upstream side of the recording head 111 in the transporting direction. The driven roller 134 is located on the downstream side of the recording head 111 in the transporting direction. The belt 135 is looped around the driving roller 133 and the driven roller 134. When the driving roller 133 is driven and rotated, the belt 135 rotates with the rotation of the driving roller 133 and transports the paper sheet P downstream. Thus, the outer surface of the belt 135 serves as a support surface for supporting the paper sheet P on which the image is recorded.

The transportation path 120 includes a feed path 140 for transporting the paper sheet P toward the recording section 110, a discharge path 150 for transporting the paper sheet P on which the image has already been recorded by the recording section 110, and a branch path 160 branching off from the discharge path 150.

The feed path 140 includes a first feed path 141, a second feed path 142, and a third feed path 143. The first feed path 141 transports the paper sheet P inserted through an insertion slot 141*b*. The insertion slot 141*b* is exposed by opening a paper feed cover 141*a*. The paper feed cover 141*a* is provided on the right side of the housing 101. The first feed path 141 has a first driving roller pair 144. When the first driving roller pair 144 is driven and rotated, the paper sheet P inserted through the insertion slot 141*b* is transported linearly toward the recording section 110 accordingly.

The second feed path 142 transports the paper sheet P held in each of the paper cassettes 103 to the recording section 110. As already mentioned, the paper cassettes 103 are provided in the lower part of the housing 101 in the vertical direction Z. The second feed path 142 has a pickup roller 142*a*, a separation roller pair 145, and a second driving roller 146. The pickup roller 142*a* and the separation roller pair 145 are located near each of the paper cassettes 103. The pickup roller 142*a* picks up one or more paper sheets P including the top paper sheet in the stack of paper sheets P held in the paper cassette 103, and the separation roller pair 145 separates the picked-up paper sheets P from each other. Then, the separated paper sheet P is transported toward the recording section 110 by rotation of the second driving roller 146 provided along the second feed path 142 while being turned over in the vertical direction Z.

In double-sided printing in which images are recorded on both sides of the paper sheet P, the third feed path 143 transports the paper sheet P back to the recording section 110 after the recording section 110 performs recording on one side of the paper sheet P. For double-sided printing, the branch path 160 branching off from the discharge path 150 is located on the downstream side of the recording section 110 in the transporting direction. In double-sided printing, the paper sheet P is transported to the branch path 160 by the action of a branch mechanism 147 which is provided in the discharge path 150. The branch path 160 has a branch roller pair 161 capable of rotating forward and backward. The branch roller pair 161 is located on the downstream side of the branch mechanism 147.

After an image is recorded on one side of the paper sheet P in double-sided printing, the paper sheet P is guided to the branch path 160 by the branch mechanism 147 and transported downstream in the branch path 160 by the branch roller pair 161 rotating forward. The paper sheet P transported to the branch path 160 is then transported back to the upstream side from the downstream side in the branch path 160 by the branch roller pair 161 rotating backward.

The paper sheet P transported back from the branch path 160 is transported to the third feed path 143 and then transported toward the recording section 110 by the transporting roller pairs 131. The third feed path 143 bypasses the recording section 110 and merges with the first feed path 141 and the second feed path 142 at a position upstream of the recording section 110. The third feed path 143 has a third driving roller pair 148 that is driven and rotated to transport the paper sheet P toward the recording section 110. While being transported in the third feed path 143, the paper sheet P is turned over so that the other side of the paper sheet P where no image is recorded yet can face the recording section 110. Thus, the third feed path 143 serves as an inverse transportation path for turning the paper sheet P over in the vertical direction Z while transporting the paper sheet P.

Out of the first feed path 141, the second feed path 142, and the third feed path 143, each of the second feed path 142 and the third feed path 143 transports the paper sheet P toward the recording section 110 while curving the paper sheet P in the vertical direction Z. In contrast, the first feed path 141 transports the paper sheet P toward the recording section 110 without markedly curving the paper sheet P, compared to the second feed path 142 and the third feed path 143.

An alignment roller pair 149 is provided on the upstream side of the recording section 110 in the transporting direction. The paper sheet P transported through the first, second, and third feed paths 141, 142, and 143 is transported to the alignment roller pair 149 that stops rotating, and the front end of the paper sheet P hits the stopped alignment roller pair 149. Thus, the paper sheet P hits the stopped alignment roller pair 149 so that the skew of the paper sheet P with respect to the transporting direction can be corrected. After the skew of the paper sheet P is corrected, the alignment roller pair 149 is driven and rotated so that the paper sheet P can be aligned and transported to the recording section 110.

After the recording section 110 completes the recording on the paper sheet P by recording the image on one or both sides of the paper sheet P, the transporting roller pairs 131 transport the paper sheet P in the discharge path 150, which is the downstream part of the transportation path 120. The discharge path 150 branches into a first discharge path 151, a second discharge path 152, and a third discharge path 153 at a position downstream of a branching point where the branch path 160 branches off from the discharge path 150. The upstream part of the discharge path 150 serves as a common discharge path 154, and the downstream end of the common discharge path 154 is provided with a selector 180. After the recording of the paper sheet P is completed, the paper sheet P is transported through the common discharge path 154 and selectively guided by the selector 180 to any one of the first discharge path 151, the second discharge path 152, and the third discharge path 153, which form the downstream part of the discharge path 150.

The first discharge path 151 extends toward the upper part of the housing 101 and is curved along the branch path 160. The paper sheet P transported through the first discharge path 151 is discharged from a discharge slot 155 as the end of the first discharge path 151. The discharge slot 155 is an opening formed in the housing 101. The paper sheet P discharged from the discharge slot 155 falls downward in the vertical direction Z and is discharged to a mount base 156 in the form of a stack as indicated by a two-dot chain line in FIG. 2. It is noted that in single-sided printing, the transporting roller pairs 131 arranged at multiple positions in the discharge path 150 allow the paper sheet P to be discharged from the discharge slot 155 to the mount base 156 so that the recording side of the paper sheet P can face downward in the vertical direction Z.

The mount base 156 is inclined upward in the vertical direction Z, toward a discharge direction in which the paper sheet P is discharged from the discharge slot 155. In FIG. 2, the discharge direction is a direction toward the right in the right/left direction X. The paper sheet P is mounted on the mount base 156 in the form of a stack. Each paper sheet P mounted on the paper sheet P slides down to the left by the inclination of the mount base 156 so that a stack of the paper sheets P can be mounted near a standing wall 157 which is located below the discharge slot 155 of the housing 101.

The first discharge path 151 has a curved inversion path 151*a*. The paper sheet P recorded by the recording section 110 is turned over by the curved inversion path 151*a* before being transported to the discharge slot 155. Specifically, the curved inversion path 151*a* curves the paper sheet P so that the recording side of the paper sheet P can face inward, thereby turning the paper sheet P over so that the recording side facing upward can face downward in the vertical direction Z. As such, in single-sided printing, the paper sheet P transported through the curved inversion path 151*a* is discharged from the discharge slot 155 so that the recording side can face the mount base 156.

The second discharge path 152 branches off from the discharge path 150 so as to be positioned below the first discharge path 151 in the vertical direction Z and extends linearly from the recording section 110 toward the pullout wall 108 which is part of the housing 101. In the second discharge path 152, the paper sheet P is transported in a straight line, without being curved like the paper sheet P transported in the first discharge path 151, and discharged from the discharge slot 109 of the pullout wall 108. As such, the paper sheet P maintains its orientation almost unchanged until being discharged from the discharge slot 109 after passing through the recording section 110. Thus, the second discharge path 152 serves as a non-inverse discharge path for discharging the paper sheet P without turning the paper sheet P over in the vertical direction Z. The third discharge path 153 branches off from the discharge path 150 to be positioned below the second discharge path 152 in the vertical direction Z and extends obliquely downward in the vertical direction Z toward the lower part of the housing 101. The third discharge path 153 is connectable to a post-processing path 211 of a post-processing apparatus that performs post-processing on the paper sheet P, such as drying and sorting.

The movable unit 170 is provided in the housing 101 and has a transportation path section 121 including part of the discharge path 150 and part of the branch path 160. Specifically, the transportation path section 121 includes the curved inversion path 151*a*, the second discharge path 152, the third discharge path 153, part of the common discharge path 154, and part of the branch path 160. In summary, the movable unit 170 includes the transportation path section 121 that is part of the transportation path 120. The movable unit 170 is connected to the pullout wall 108 in such a manner that the movable unit 170 and the pullout wall 108 can be operated as a unit. As such, when the pullout wall 108 is pulled out, the movable unit 170 is pulled out from the housing 101 accordingly and exposed outside the housing 101.

A first path member 171 and a second path member 172 are rotatably attached to the movable unit 170 and rotatable about a shaft 173 provided in the movable unit 170. The first path member 171 forms part of the curved inner guide surface of the first discharge path 151 and part of the curved outer guide surface of the branch path 160. The second path member 172 forms part of the curved inner guide surface of the branch path 160. Thus, the inside of the branch path 160 and the inside of the first discharge path 151 are exposed (refer to FIG. 5) by rotating the first and second path members 171 and 172 about the shaft 173 in a clockwise direction illustrated in FIG. 2 with the movable unit 170 pulled out (refer to FIG. 4).

The selector 180 includes a first guide 181 and a second guide 182. The first and second guides 181 and 182 are provided at a branching point 190 where the downstream end of the common discharge path 154 branches into the first discharge path 151, the second discharge path 152, and the third discharge path 153. The first and second guides 181 and 182 are displaced from each other in the right/left direction X which is the transporting direction in which the paper sheet P is transported from the recording section 110. Specifically, the first guide 181 is positioned on the right side of the second guide 182. In other words, the first guide 181 is positioned on the upstream side of the second guide 182.

Further, the first and second guides 181 and 182 are displaced from each other in the vertical direction Z such that the first guide 181 is positioned below the second guide 182.

The first guide 181 is rotatable about a shaft (not shown) provided at a base end which is the downstream end (i.e., the left end) of the first guide 181 in the transporting direction (i.e., in the right/left direction X). Likewise, the second guide 182 is rotatable about a shaft (not shown) provided at a base end which is the downstream end (i.e., the left end) of the second guide 182 in the transportation direction (i.e., in the right/left direction X). As the first guide 181 rotates about the shaft, a tip end, opposite to the base end, which is the upstream end (i.e., the right end) of the first guide 181 in the transporting direction (i.e., in the right/left direction X) moves up and down in the vertical direction Z. Likewise, as the second guide 182 rotates about the shaft, a tip end, opposite to the base end, which is the upstream end (i.e., the right end) of the second guide 182 in the transportation direction (i.e., in the right/left direction X) moves up and down in the vertical direction Z. Thus, each of the first and second guides 181 and 182 can rotate between an upper position and a lower position. In the upper position, the tip end which is the upstream end of each of the first and second guides 181 and 182 in the transporting direction of a paper sheet P is positioned near the first path member 171. In the lower position, the tip end of each of the first and second guides 181 and 182 is positioned away from the first path member 171. It is noted that the tip end of the first guide 181 is positioned upstream of the tip end of the second guide 182 in the transporting direction of the paper sheet P.

The first and second guides 181 and 182 are selectively switched between the upper position and the lower position so as to come into contact with the paper sheet P being transported through the common discharge path 154, thereby guiding the paper sheet P to any one of the first, second, and third discharge paths 151, 152, and 153. The first and second guides 181 and 182 are formed so that their rotations do not interfere with each other. To prevent such interference, for example, the first and second guides 181 and 182 may be comb teeth shaped from the base end to the tip end. The rotations of the first and second guides 181 and 182 are controlled by a controller 300 (refer to FIG. 15) of the printer 100.

When both the first guide 181 and the second guide 182 are in the lower position, the tip end of the first guide 181 covers the upstream end of the third discharge path 153, and the tip end of the second guide 182 covers the upstream end of the second discharge path 152. As such, the selector 180 guides the paper sheet P being transported through the common discharge path 154 to the first discharge path 151.

When the first guide 181 is in the lower position, and the second guide 182 is in the upper position, the tip end of the first guide 181 covers the upstream end of the third discharge path 153, and the tip end of the second guide 182 covers the upstream end of the first discharge path 151. As such, the selector 180 guides the paper sheet P being transported through the common discharge path 154 to the second discharge path 152.

When both the first guide 181 and the second guide 182 are in the upper position, the tip end of the first guide 181 covers both the upstream end of the first discharge path 151 and the upstream end of the second discharge path 152, and the tip end of the second guide 182 covers the upstream end of the first discharge path 151. As such, the selector 180 guides the paper sheet P being transported through the common discharge path 154 to the third discharge path 153.

Next, a procedure to fix problems with transporting the paper P in the printer 100 is described.

A recording apparatus, such as the printer 100 illustrated in FIG. 2, which performs recording on a sheet medium like the paper sheet P and transports the medium, sometimes encounters transportation problems such as paper jams in a transportation path. In particular, in a recording apparatus which performs recording on a medium by discharging a liquid such as ink onto the medium, the transportation problems are more likely to occur on the downstream side of the recording section 110 than on the upstream side of the recording section 110. This is because the recording side of the paper sheet P expands due to the liquid so as to curl the paper sheet P such that the recording side becomes convex. To facilitate removal of the paper sheet P that is jammed or has other problems during transportation, the printer 100 according to the present embodiment allows part of the discharge path 150 and part of the branch path 160 to be pulled out from the housing 101 by moving the movable unit 170.

The movable unit 170 is at least partially located in the space 101*a*. The movable unit 170 is attached to the housing 101 and movable relative to the housing 101. The movable unit 170 is movable in the right/left direction X which is the transporting direction of the paper P. The position of the movable unit 170 relative to the housing 101 changes between a storage position (refer to FIG. 2) and a maximum pulled-out position (refer to FIG. 4). The maximum pulled-out position is on the downstream side (i.e., the left side) of the storage position in the transporting direction of the paper P (i.e., in the right/left direction X). When the movable unit 170 is in the storage position, the movable unit 170 is nearest the upstream side (i.e., the right side) in the transporting direction (i.e., in the right/left direction X). When the movable unit is in the maximum pulled-out position, the movable unit 170 is pulled out to the maximum extent from the housing 101. When the movable unit 170 is in the storage position, the transportation path section 121 is stored in the space 101*a*, and the area of the opening 105*a* covered by a side end 176 of the movable unit 170 is relatively large. The side end 176 is a portion of the movable unit 170 and is positioned on the cover 104 side of the movable unit 170. Further, when the movable unit 170 is in the storage position, a clearance formed in the space 101*a* is minimized. When the movable unit 170 is in a normal pulled-out position somewhere between the storage position and the maximum pulled-out position, the transportation path section 121 is pulled out of the space 101*a*, and the area of the opening 105*a* covered by the side end 176 of the movable unit 170 is relatively small. Further, when the movable unit 170 is in the maximum pulled-out position, the area of the opening 105*a* covered by the side end 176 of the movable unit 170 is minimized or reduced to zero. The clearance formed in the space 101*a* is larger when the movable unit 170 is in the normal pulled-out position than when the movable unit 170 is in the storage position. The clearance formed in the space 101*a* is maximized when the movable unit 170 is in the maximum pulled-out position. In the description below, a pulled-out direction XA refers to a direction that is parallel to the right/left direction X and in which the movable unit 170 moves to reduce the covered area of the opening 105*a*, and a storage direction XB refers to a direction that is parallel to the right/left direction X and in which the movable unit 170 moves to increase the covered area of the opening 105*a*. Further, the normal pulled-out position and the maximum pulled-out position are hereinafter collectively referred to as a pulled-out position. The movable unit 170 moves in a direction from the storage position to the pulled-out direction when moving in the pulled-out direction XA. The movable unit 170 moves in a direction from the pulled-out position to the storage position when moving in the storage direction XB.

Figure 4:
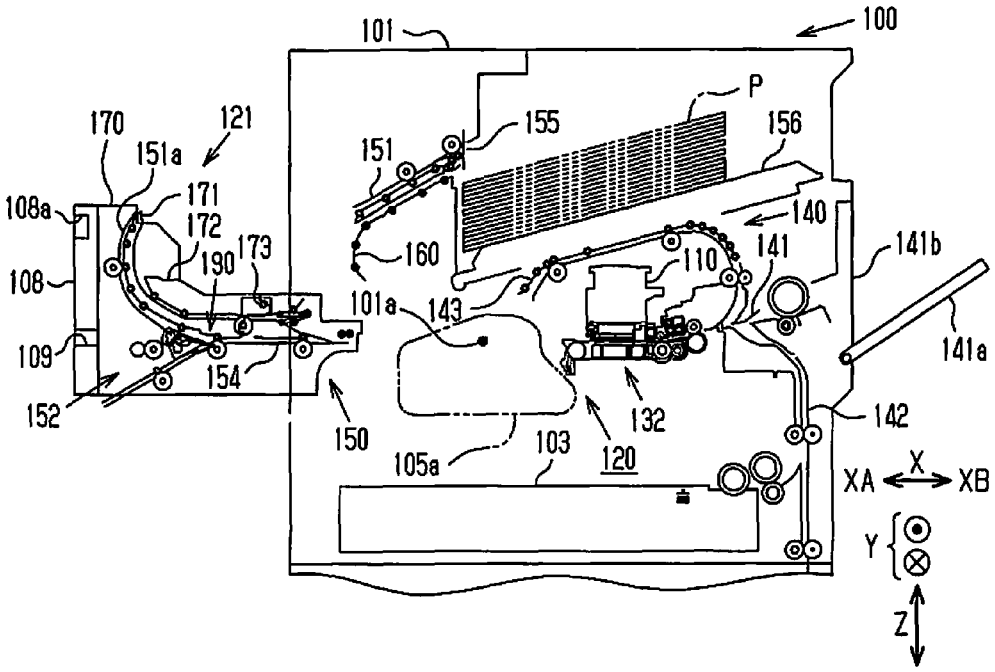
FIG. 4 is a schematic view of part of the medium transporting apparatus seen when the movable unit is pulled out.

When the paper sheet P is jammed in the discharge path 150 and the branch path 160, a user grasps the grip 108*a* on the pullout wall 108 and pulls the pullout wall 108 out in the pulled-out direction XA as illustrated in FIG. 4. The pulled-out direction is a direction toward the left in the right/left direction X which is the transporting direction of the paper P. As the pullout wall 108 is pulled out, the movable unit 170 is pulled out from the housing 101 along with the pullout wall 108. The transportation path section 121 is pulled out accordingly. Further, the selector 180 provided at the branching point 190 which is the downstream end of the common discharge path 154 is also pulled out from the housing 101.

Figure 5:
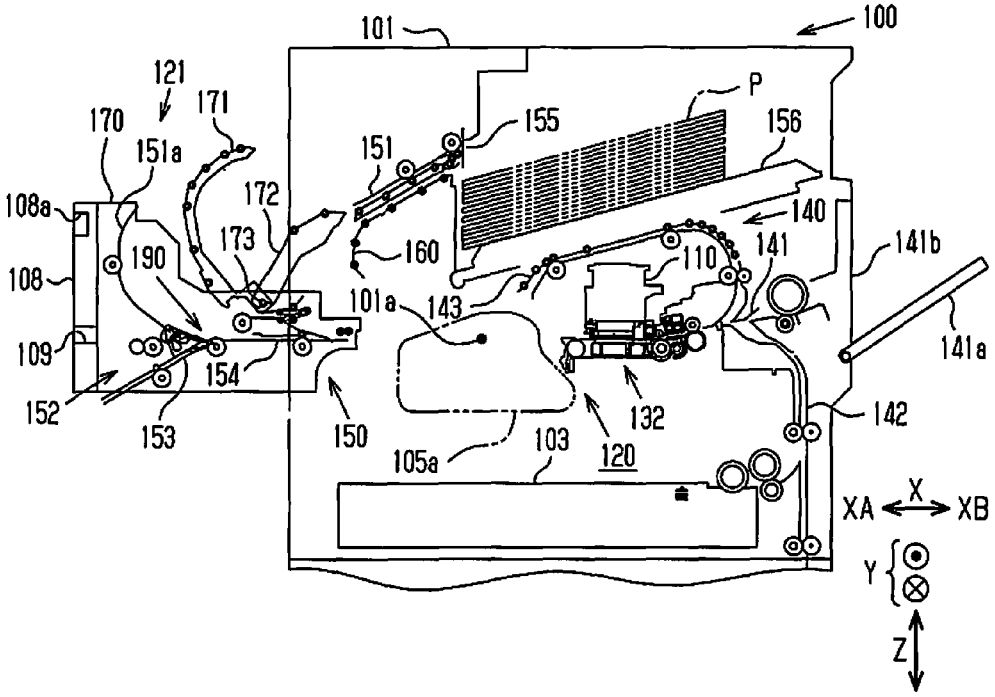
FIG. 5 is a schematic view of part of the medium transporting apparatus seen when path members are rotated with the movable unit pulled out.

After the movable unit 170 is pulled out from the housing 101, the first path member 171 and the second path member 172 which are attached to the movable unit 170 are rotated around the shaft 173 in the clockwise direction as illustrated in FIG. 5. The inner and outer guide surfaces of the curved inversion path 151*a* of the first discharge path 151 are separated from each other, and the inner and outer guide surfaces of the branch path 160 are separated from each other. Since the respective inner and outer guide surfaces of the curved inversion path 151*a* and the branch path 160 are separated from each other, the inside of the curved inversion path 151*a* and the inside of the branch path 160 are exposed so that the paper sheet P being jammed in the curved inversion path 151*a* and the branch path 160 can be removed.

There is a possibility that the paper sheet P may remain in the space 101*a* of the housing 101, not in the movable unit 170. To fix this transportation problem, the cover 104 is moved to the open position (refer to FIG. 3) so that the opening 105*a* can be uncovered, and the remaining paper sheet P is then removed through the opening 105*a*. A limiter 200 is provided between the movable unit 170 and the cover 104 to restrain the movement of the movable unit 170 in accordance with the position of the cover 104.

The limiter 200 is described below with reference to FIG. 3 and FIGS. 6 to 14. As illustrated in FIG. 3, the limiter 200 includes multiple first engagement members 177, a second engagement member 201, a rotary shaft 204 (refer to FIG. 7), and a biasing member 205 (refer to FIG. 9). The first engagement members 177 are formed on the side end 176 of the movable unit 170. The side end 176 is positioned on the cover 104 side of the movable unit 170 and faces the first side wall 106. The first engagement members 177 correspond to "a first engagement member provided at a portion of a cover side of a movable unit". The first engagement members 177 are arranged in the right/left direction X which is a moving direction in which the movable unit 170 moves. As illustrated in FIG. 9, each of the first engagement members 177 is formed as a recess, and has a first surface 178 on the pulled-out-position side and a second surface 179 on the storage-position side. The first surface 178 is substantially perpendicular to the moving direction of the movable unit 170 (i.e., the right/left direction X). The second surface 179 is inclined toward the outside of the movable unit 170 in a direction from the pulled-out position to the storage position.

Figure 6:
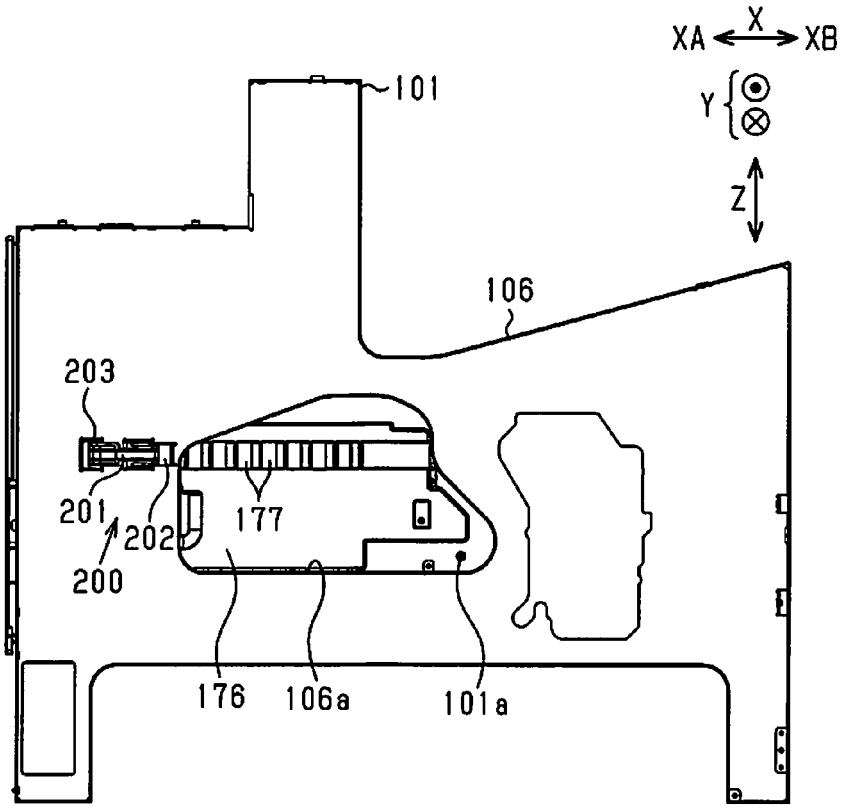
FIG. 6 is a front view illustrating a first side wall and the movable unit.

The second engagement member 201 includes a first end 202 capable of being in contact with the cover 104 and a second end 203 engageable with each of the first engagement members 177. As illustrated in FIGS. 3 and 9, the first end 202 is exposable through the second side wall 107. As illustrated in FIGS. 6 and 9, the second end 203 is located between the first side wall 106 and the second side wall 107. The second end 203 has a first surface 203*a* on the pulled-out-position side and a second surface 203*b* on the storage-position side.

The first surface 203*a* is substantially perpendicular to the moving direction of the movable unit 170 (i.e., the right/left direction X). The first surface 178 of each of the first engagement members 177 is capable of being in surface contact with the first surface 203*a* of the second end 203 when the movable unit 170 moves. The first surface 178 of any of the first engagement members 177 and the first surface 203*a* of the second end 203 are in contact with each other to restrain the movement of the movable unit 170 in the storage direction XB. Thus, the first surface 178 of each of the first engagement members 177 and the first surface 203*a* of the second end 203 work in combination to restrain the movement of the movable unit 170. The second surface 203*b* is inclined so that the distance between the second surface 203*b* and the movable unit 170 increases in the direction from the pulled-out-position side to the storage-position side. When the movable unit 170 moves, the second surface 179 of the first engagement member 177 and the second surface 203*b* of the second end 203 can slide relative to each other while being in surface contact with each other.

Figure 7:
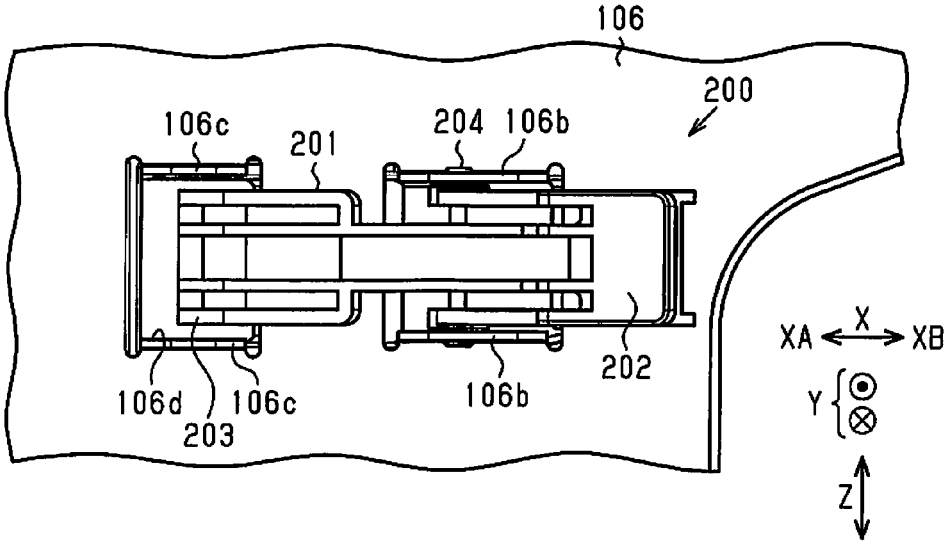
FIG. 7 is an enlarged view of FIG. 6 and illustrates a limiter.

As illustrated in FIG. 7, the rotary shaft 204 goes through the middle between the first end 202 and the second end 203 in the vertical direction Z. The rotary shaft 204 is supported by a pair of first bent portions 106*b* that are formed by bending part of the first side wall 106 toward the cover 104. The second engagement member 201 is supported by the rotary shaft 204 and is rotatable about the rotary shaft 204. The biasing member 205 is attached between the side wall 105 and the first end 202 so as to apply a force to the second engagement member 201 so that the first end 202 can be moved toward the cover 104.

A pair of second bent portions 106*c* are formed by bending part of the first side wall 106 outward and are located facing the first end 202. A hole 106*d* is formed in the first side wall 106 between the pair of second bent portions 106*c* so that the first end 202 can be inserted through the hole 106*d*. As illustrated in FIG. 9, the hole 106*d* in the first side wall 106 is located at substantially the same position as each of the first engagement members 177 in the vertical direction Z.

Figure 8:
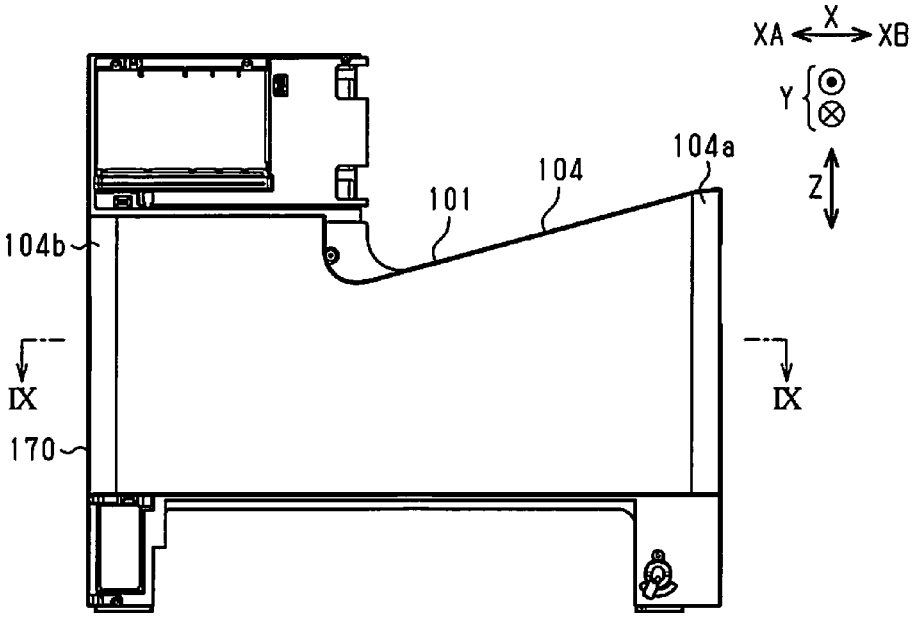
FIG. 8 is a front view illustrating a state where the movable unit is in a storage position and where the cover is in a closed position.
Figure 9:
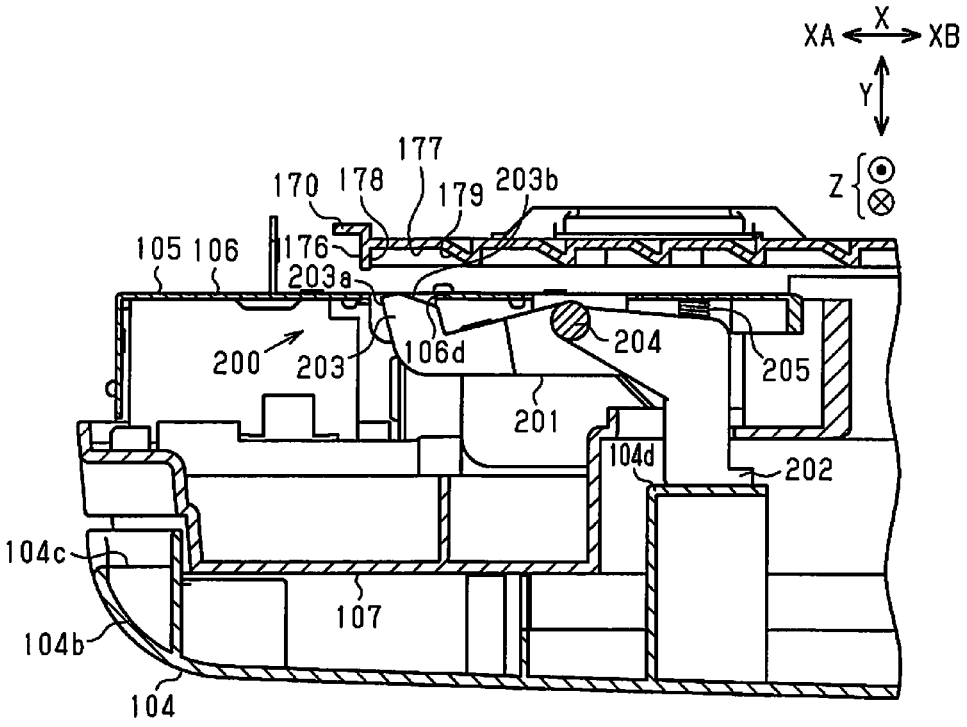
FIG. 9 is a sectional view taken along line IX-IX in FIG. 8.

As illustrated in FIGS. 8 and 9, when the cover 104 is in the closed position, the first end 202 of the second engagement member 201 is in contact with the cover 104 while the second end 203 of the second engagement member 201 is separated from the first engagement member 177. Specifically, a contact portion 104*d* on the back of the cover 104 is pressed against the first end 202 of the second engagement member 201. Accordingly, a force applied from the cover 104 to the second engagement member 201 exceeds the force applied from the biasing member 205 to the second engagement member 201, thus separating the first end 202 of the second engagement member 201 from the first engagement member 177. This allows the movement of the movable unit 170. In summary, the limiter 200 allows the movable unit 170 to move toward the storage position when both the following conditions are satisfied: the movable unit 170 is in the pulled-out position; the cover 104 is in the closed position.

Figure 10:
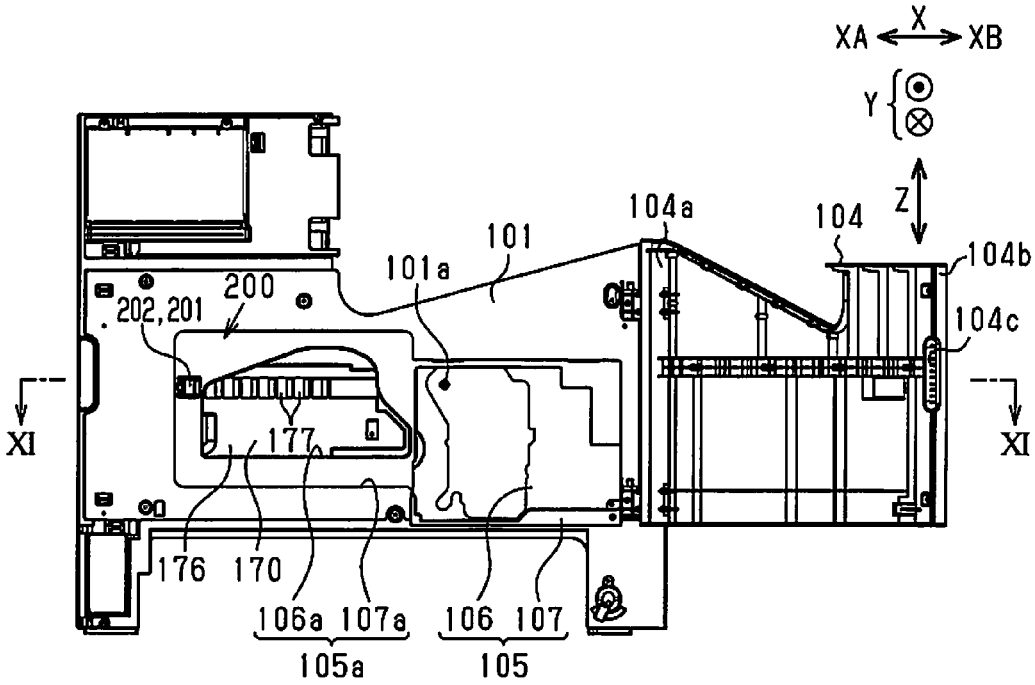
FIG. 10 is a front view illustrating a state where the movable unit is in the storage position and where the cover is in an open position.
Figure 11:
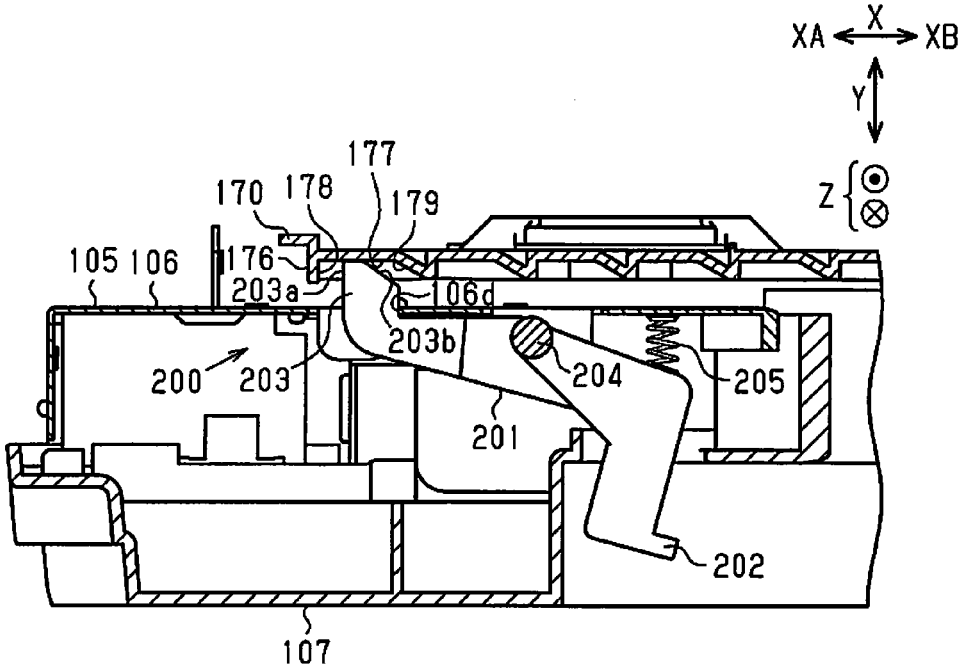
FIG. 11 is a sectional view taken along line XI-XI in FIG. 10.

As illustrated in FIGS. 10 and 11, when the cover 104 is in the open position, the first end 202 of the second engagement member 201 is separated from the cover 104 while the second end 203 of the second engagement member 201 engages with the first engagement member 177. Specifically, since the contact portion 104*d* on the back of the cover 104 is separated from the second engagement member 201, the first end 202 of the second engagement member 201 is fitted into the first engagement member 177 due to the force applied from the biasing member 205. This restrains the movement of the movable unit 170.

Figure 12:
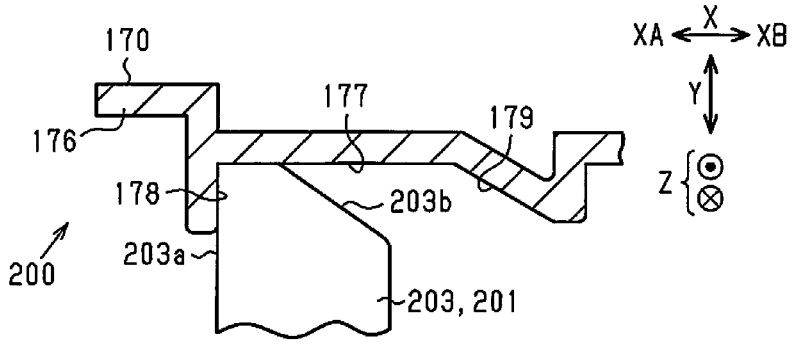
FIG. 12 is an illustration of a first state of the limiter.

When the movable unit 170 receives a force in the storage direction XB while the cover 104 is in the open position, the first surface 178 of the first engagement member 177 comes in surface contact with the first surface 203*a* of the second end 203 as illustrated in FIG. 12. Thus, the movement of the movable unit 170 in the storage direction XB is restrained because each of the first surface 178 of the first engagement member 177 and the first surface 203*a* of the second end 203 is perpendicular to the storage direction XB. In summary, the limiter 200 restrains the movement of the movable unit 170 toward the storage position when both the following conditions are satisfied: the movable unit 170 is in the pulled-out position; the cover 104 is in the open position.

Figure 13:
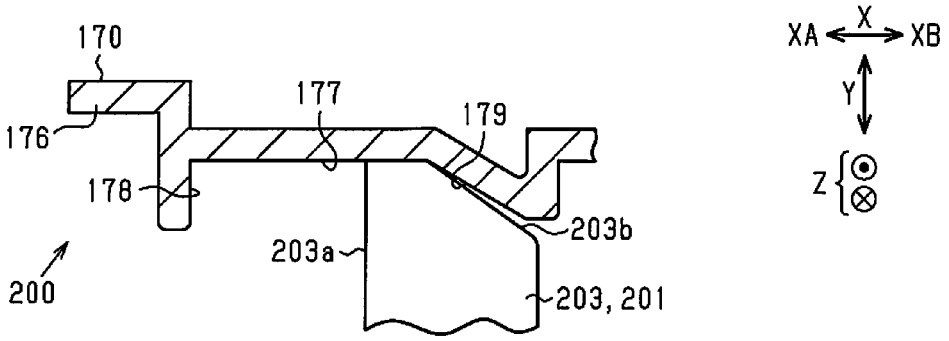
FIG. 13 is an illustration of a second state of the limiter.
Figure 14:
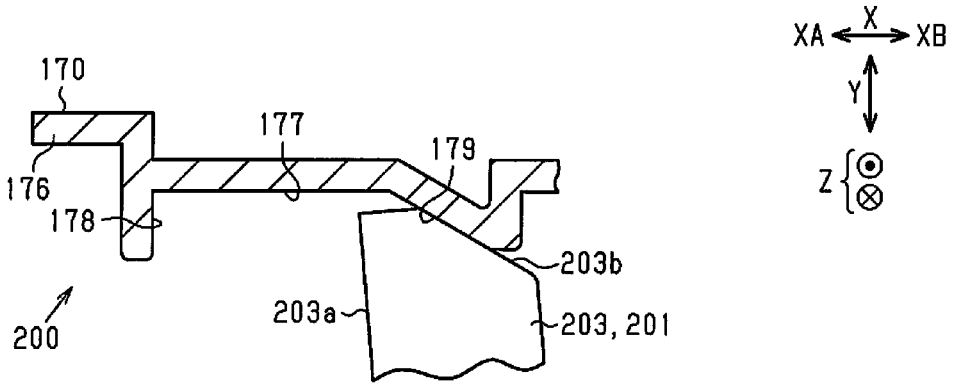
FIG. 14 is an illustration of a third state of the limiter.

In contrast, when the movable unit 170 receives a force in the pulled-out direction XA while the cover 104 is in the open position, the second surface 179 of the first engagement member 177 comes in contact with the second surface 203*b* of the second engagement member 201 as illustrated in FIG. 13. Under this condition, when the movable unit 170 receives more force in the pulled-out direction XA, the second surface 179 of the first engagement member 177 slides onto the second surface 203*b* of the second engagement member 201 and slightly rotates the second engagement member 201 as illustrated in FIG. 14. Thus, the second surface 179 of the first engagement member 177 and the second surface 203*b* of the second engagement member 201 are in surface contact with each other. The second surface 179 of the first engagement member 177 moves in the pulled-out direction XA while sliding on the second surface 203*b* of the second engagement member 201. When the movable unit 170 further moves in the pulled-out direction XA, the second engagement member 201 is fitted into another one of the first engagement members 177 adjacent thereto on the storage-position side. As such, when the movable unit 170 moves in the pulled-out direction XA to reduce the covered area of the opening 105*a* while the cover 104 is in the open position, the second end 203 of the second engagement member 201 can move along the second surface 203*b*. In summary, when the cover 104 is in the open position, the limiter 200 restrains the movable unit 170 from moving in the storage direction XB, but allows the movable unit 170 to move in the pulled-out direction XA.

Next, the operation of the printer 100 is described. In the printer 100, the paper sheet P in the transportation path 120 of the movable unit 170 can be removed by moving the movable unit 170 from the storage position to the pulled-out position. Further, when the paper sheet P is in an inappropriate state, such as when the paper sheet P falls into the space 101*a*, the paper sheet P can be removed through the opening 105*a* by opening the cover 104. Here, there is a possibility that when the movable unit 170 is returned from the pulled-out position back to the storage position with the paper sheet P remaining in the space 101*a*, the paper sheet P may become crumpled or torn.

The printer 100 has the limiter 200 that restrains the movable unit 170 from moving in the storage direction XB when the cover 104 is in the open position. Thus, the limiter 200 reduces the likelihood of the movable unit 170 crumpling or tearing the paper sheet P, as long as the cover 104 remains in the open position. A user closes the cover 104 before moving the movable unit 170 back to the storage position. Therefore, when closing the cover 104, a user has an opportunity to visually check whether the paper sheet P remains in the space 101*a* in an inappropriate state. This reduces the likelihood of the movable unit 170 being returned to the storage position without removing the paper sheet P remaining in the space 101*a* in an inappropriate state. Further, when a user tries to remove the paper sheet P through the opening 105*a*, the movable unit 170 is restrained from moving toward the storage position until the user finishes removing the paper sheet P and closes the cover 104. This reduces the likelihood of the movable unit 170 being returned to the storage position without a user finishing removal of the paper sheet P.

The embodiment described above has at least the following advantages.

(1) The printer 100 has the limiter 200 that restrains the movable unit 170 being in the pulled-out position from moving toward the storage position when the cover 104 is in the open position. This reduces the likelihood of the movable unit 170 being returned to the storage position without removing the paper sheet P that is in an inappropriate state, thus reducing the likelihood of difficulty in removing the paper sheet P.

(2) The limiter 200 of the printer 100 restrains the movement of the movable unit 170 by using a simple mechanism that separates the first end 202 of the second engagement member 201 from the cover 104 so that the second end 203 of the second engagement member 201 can engage with the first engagement member 177. This restrains the movable unit 170 from moving from the pulled-out position back to the storage position without additional devices, such as driving sources and sensors.

(3) When the movable unit 170 moves in the pulled-out direction XA so as to reduce the covered area of the opening 105*a*, the likelihood of the paper sheet P that is in the space 101*a* in an inappropriate state being crumpled or torn is small, as compared to when the movable unit 170 moves toward the storage position. Therefore, allowing the movable unit 170 to move in the pulled-out direction XA so as to reduce the covered area of the opening 105*a* is acceptable. In view of the above, in the printer 100, the movable unit 170 is allowed to move in the pulled-out direction XA regardless of whether the cover 104 is in the open position or in the closed position. As such, when moving the movable unit 170 in the pulled-out direction XA so as to reduce the covered area of the opening 105*a*, a user does not have to move the cover 104 that is in the open position to the closed position. This decreases a possibility of impairing usability.

(4) When the movable unit 170 moves, the second surface 179 of the first engagement member 177 and the second surface 203*b* of the second end 203 slide relative to each other. Thus, the second end 203 is less likely to be caught by the first engagement member 177 and, as a result, the movable unit 170 can move smoothly.

(5) In the printer 100, when the movable unit 170 is in the pulled-out position, the transportation path section 121 included in the movable unit 170 is exposed. Thus, the paper sheet P jammed in the transportation path section 121 can be removed by moving the movable unit 170 to the pulled-out position.

(6) The second bent portions 106*c* are provided around the hole 106*d* in the first side wall 106. As such, the second bent portions 106*c* reduce the likelihood of the second engagement member 201 being displaced in the vertical direction Z.

Figure 15:
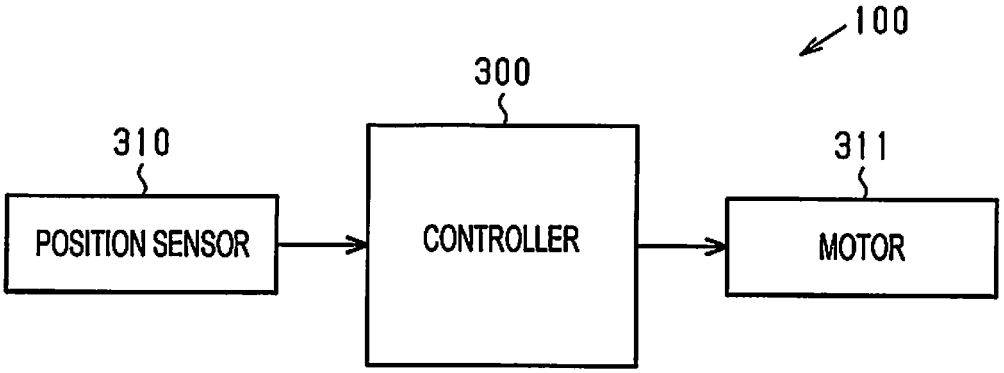
FIG. 15 is a block diagram of a printer according to a modification.

The above embodiment can be modified in various ways. Examples of the modifications are described below. In one modification, as illustrated in FIG. 15, the printer 100 may have a position sensor 310 for detecting the position of the cover 104 and a motor 311 for driving the limiter 200. Examples of the position sensor 310 can include an optical sensor for detecting the position of the tip end 104*b* of the cover 104 and a rotary encoder for detecting the rotation angle of the base end 104*a* relative to the side wall 105. The motor 311 can be connected to, for example, the rotary shaft 204 of the second engagement member 201 so as to control the rotation of the rotary shaft 204. The controller 300 drives the motor 311 in accordance with the output of the position sensor 310 so that the limiter 200 can restrain the movable unit 170 that is in the pulled-out position from moving toward the storage position when the cover 104 is in the open position. According to this modification, the controller 300 can drive the limiter 200 with appropriate timing.

In another modification, when the cover 104 is in the open position, the movable unit 170 may be restrained from moving in the pulled-out direction XA as well as in the storage direction XB. This can be achieved by, for example, forming the second surface 179 of the first engagement member 177 and the second surface 203*b* of the second engagement member 201 so that the second surfaces 179 and 203*b* can be perpendicular to the right/left direction X. As such, when the cover 104 is in the open position, the movement of the movable unit 170 in the pulled-out direction XA can be restrained.

In another modification, the second surface 179 of the first engagement member 177 and the second surface 203*b* of the second engagement member 201 may have different shapes. For example, the second end 203 of the second engagement member 201 may be tapered so as to become narrower toward the tip. In this case, the second surface 179 of the first engagement member 177 and the second end 203 of the second engagement member 201 are in point contact with each other.

In another modification, the first engagement member 177 may be formed as a projection, and the second end 203 of the second engagement member 201 may have a recess. In fact, the first engagement member 177 and the second engagement member 201 can have any structure as long as the first engagement member 177 and the second engagement member 201 can engage with each other.

In another modification, at least one of a waste liquid tank and a paper cassette may be provided in the movable unit 170 instead of or in addition to the part of the transportation path 120. The movable unit 170 is pulled out for maintenance of the waste liquid tank or for loading of the paper sheet P into the paper cassette. Even in this case, the limiter 200 reduces the likelihood of the movable unit 170 being returned to the storage position without removal of the paper sheet P that is in the space 101*a* in an inappropriate state.

As already described in the embodiment, the outer surface of the belt 135 of the belt transporter 132 serves as a support surface that supports the paper sheet P when the recording section 110 performs recording on the paper sheet P. The support surface is not limited to the outer surface of the belt 135. For example, the printer 100 may have an additional support base, and the top surface of the support base in the vertical direction Z may be used as the support surface.

The transporting section 130 for transporting the paper sheet P in the transportation path 120 is not limited to the transporting roller pairs 131. For example, the transporting section 130 may have a conveyor. The recording head 111 of the recording section 110 is not limited to a line head and may be a serial head capable of moving in a direction that intersects with the transporting direction of the paper sheet P and that is parallel to the width of the paper sheet P.

The medium transporting apparatus described in the embodiment is an example of fluid ejecting apparatuses according to an aspect of the invention, and this aspect of the invention can be applied widely to common fluid ejecting apparatuses that perform recording by ejecting or discharging fluids, which may be not ink, including liquids, liquid materials containing particles of functional materials dispersed or mixed in liquids, and gel-like liquid materials. Examples of such fluid ejecting apparatuses include liquid ejecting apparatuses that perform recording by ejecting liquid materials containing dispersed or dissolved materials used for forming electrodes or color filters/pixels in displays, such as liquid crystal displays, electroluminescent (EL) displays, or field emission displays. Alternatively, such fluid ejecting apparatuses may eject fluid materials such as gels (e.g., physical gels). The aspect of the invention can be applied to any of such fluid ejecting apparatuses. It is noted that the word "fluid" in the specification is defined to exclude fluids containing only gas. Thus, the word "fluid" means liquids (e.g., inorganic solvents, organic solvents, liquid resins, and liquid metals (metallic melts)), liquid materials, and fluid materials.

The entire disclosure of Japanese Patent Application No. 2016-059680, filed Mar. 24, 2016 is expressly incorporated by reference herein.

What is claimed is:

1. A medium transporting apparatus comprising:

a housing having a space and an opening, the space accommodating a transportation path section that is part of a transportation path for transporting a medium, the opening allowing the space to communicate with an outside of the housing;

a cover in any one of relative positions relative to the opening, the relative positions including a closed position where the cover covers the opening and an open position where the cover uncovers the opening;

a movable unit having the transportation path section and movable between a storage position where the transportation path section is stored in the space and a pulled-out position where the transportation path section is pulled out of the space; and a limiter that restrains the movable unit in the pulled-out position from moving toward the storage position when the cover is in the open position, the limiter allowing the movable unit in the pulled-out position to move toward the storage position when the cover is in the closed position.

2. The medium transporting apparatus according to claim 1, wherein the limiter includes a first engagement member and a second engagement member, the first engagement member being provided at a cover side of the movable unit, the second engagement member being provided at a portion of the housing that is covered by the cover when the cover is in the closed position, the second engagement member has a first end capable of being in contact with the cover and a second end capable of engaging with the first engagement member, the second engagement member is biased to allow the second end to engage with the first engagement member, when the cover is in the closed position, the first end is in contact with the cover so that the second end is separated from the first engagement member to allow the movement of the movable unit, and when the cover is in the open position, the first end is separated from the cover so that the second end engages with the first engagement member to restrain the movement of the movable unit.

3. The medium transporting apparatus according to claim 2, wherein the limiter has a plurality of first engagement members that include the first engagement member and that are arranged in a direction in which the movable unit is movable, each of the plurality of first engagement members is a recess having a first surface on a pulled-out-position side and a second surface on a storage-position side, the second surface of each of the plurality of first engagement members is inclined toward an outside of the movable unit in a direction from the pulled-out-position side to the storage-position side, and when the movable unit moves toward the pulled-out position while the cover is in the open position, the second end of the second engagement member is movable along the second surface.

4. The medium transporting apparatus according to claim 3, wherein the second end of the second engagement member has a first surface on a pulled-out-position side and a second surface on a storage-position side, the second surface of the second end is inclined so that a distance between the movable unit and the second surface of the second end increases in the direction from the pulled-out-position side to the storage-position side, the second surface of each of the plurality of first engagement members and the second surface of the second end are slidable relative to each other, and the first surface of the second end and the first surface of any of the plurality of first engagement members are in contact with each other to restrain the movement of the movable unit.

5. The medium transporting apparatus according to claim 1, further comprising:

a sensor that detects the position of the cover;

a motor that drives the limiter; and a controller that controls the motor in accordance with an output of the sensor so that the limiter restrains the movable unit in the pulled-out position from moving toward the storage position when the cover is in the open position.

6. The medium transporting apparatus according to claim 1, wherein the movable unit in the pulled-out position allows the transportation path section to be exposed.

* * * * *